US007568908B2

(12) United States Patent
Potter

(10) Patent No.: US 7,568,908 B2
(45) Date of Patent: Aug. 4, 2009

(54) LOW FIRE START CONTROL

(75) Inventor: Gary J. Potter, St. Charles County, MO (US)

(73) Assignee: Cambridge Engineering, Inc., Chesterfield, MO (US)

( * ) Notice: Subject to any disclaimer, the term of this patent is extended or adjusted under 35 U.S.C. 154(b) by 1298 days.

(21) Appl. No.: 10/223,556

(22) Filed: Aug. 19, 2002

(65) Prior Publication Data

US 2003/0003411 A1 Jan. 2, 2003

Related U.S. Application Data

(63) Continuation of application No. 09/574,338, filed on May 20, 2000, now abandoned.

(60) Provisional application No. 60/135,067, filed on May 20, 1999.

(51) Int. Cl.
*F23N 1/00* (2006.01)
*F23N 5/00* (2006.01)
*F23N 5/26* (2006.01)

(52) U.S. Cl. ..... 431/62; 431/2; 431/18; 236/1 E; 236/1 EB

(58) Field of Classification Search ..... 431/2, 431/6, 112, 8, 62, 63, 72, 73, 74, 75, 77, 431/78; 126/116 R, 116 A; 236/1 R, 1 E, 236/1 EB, 1 H, 10, 15 R
See application file for complete search history.

(56) References Cited

U.S. PATENT DOCUMENTS 3,486,693 A * 12/1969 McMann et al. ..... 236/9 A
3,742,535 A * 7/1973 Horrer et al. ..... 441/23
3,814,569 A 6/1974 Jacobsz
4,482,312 A * 11/1984 Cade ..... 431/31
4,513,910 A 4/1985 Bartels
4,852,524 A 8/1989 Cohen
5,634,786 A 6/1997 Tillander
5,692,680 A * 12/1997 Harwath et al. ..... 239/127
5,881,681 A 3/1999 Stuart
5,924,859 A 7/1999 Nolte et al.

FOREIGN PATENT DOCUMENTS

JP 56-3823 1/1981
JP 60-64125 4/1985

* cited by examiner

*Primary Examiner*—Carl D Price
(74) *Attorney, Agent, or Firm*—Paul M. Denk

(57) ABSTRACT

A direct gas-fired industrial air heater low fire start control, includes circuitry for simulating a resistant circuit which bypasses the discharge temperature sensors, the remote temperature selector, and a space temperature controls, that has the effect of driving the modulating valve to a fixed open setting which in turn changes the valve voltage in order to obtain desired gas flow. In a further embodiment, an isolated DC voltage source which normally bypasses the voltage input to the system of the modulating valve can be inserted into the circuitry to effectively drive the modulating valve to a fixed open setting to obtain the desired gas flow rate. Various circuitry, and bypass gas flow arrangements, are further shown to increase the efficiency of ignition of the burner assembly, when started.

5 Claims, 5 Drawing Sheets

BASIC MAXITROL SERIES 14
WITH LOW FIRE START VIA
SIMULATED SENSOR RESISTANCE

BASIC MAXITROL SERIES 14

BASIC MAXITROL SERIES 44

MAXITROL SERIES 44 WITH REMOTE SENSE

BASIC MAXITROL SERIES 14
WITH LOW FIRE START VIA
SIMULATED SENSOR RESISTANCE

BASIC MAXITROL SERIES 44
WITH LOW FIRE START VIA
SIMULATED SENSOR RESISTANCE

MAXITROL SERIES 44 WITH REMOTE SENSE
WITH LOW FIRE START VIA
SIMULATED SENSOR RESISTANCE

BASIC MAXITROL SERIES 14
WITH FIXED VOLTAGE INPUT
TO MODULATING VALVE

BASIC MAXITROL SERIES 44
WITH FIXED VOLTAGE INPUT
TO MODULATING VALVE

LOW FIRE START CONTROL

CROSS-REFERENCE TO RELATED APPLICATION

This application is a continuation of non-provisional patent application having Ser. No. 09/574,338, filed on May 20, 2000, now abandoned, which was based upon a provisional patent application having Ser. No. 60/135,067, filed on May 20, 1999, now abandoned, which are owned by the same inventor.

BACKGROUND OF THE INVENTION

Direct Gas-Fired Industrial Air Heaters are used extensively to provide replacement air to match air that is exhausted or to provide ventilation air in industrial and commercial occupancies. These heaters typically operate around the clock on a year round basis and it is therefore important to minimize the temperature rise of these heaters during mild weather operation so as not to overheat the space. With the airflow held constant as is the case with most make-up air heater applications, the minimum temperature rise relates to the minimum gas flow rate.

In the gas train of a direct gas-fired heater, with the modulating valve deenergized, the gas flow through the modulating valve is adjusted to obtain a minimum flow rate through a bypass circuit provided internal to the modulating valve. It is not unusual to obtain a three (3) to five (5) degree temperature rise as the minimum temperature rise. The basis for determining the minimum temperature rise is that the flame bums over the entire length of burner and that the flame length is long enough to be detected by the flame sense circuit.

Maxitrol Company, Inc. is a company that manufactures the modulating valve and other associated controls that drive the modulating valve electrically from minimum fire to high fire and points inbetween as a function of the discharge temperature of the heater and/or space temperature of the facility being served by the industrial air heater.

In addition, requirements exist from insurance underwriters for this type of equipment, specifically Industrial Risks Insurers, which indicates that ignition and the initial firing rate be limited as defined by the term "Low Fire Start". General practice of the industry has been to utilize a slow opening (typically a hydraulic operated motor) safety shutoff valve to accomplish a delay in achieving the full firing rate. An alternate means for accomplishing the Low Fire Start had been developed by the manufacturer of the modulating control system, Maxitrol, which involves removing all power from the modulating valve for a short time with a typical delay lasting for ten to thirty seconds.

For burner systems which ignite a pilot light and establish a proper flame signal for the pilot prior to energizing the main burner gas valves, the ignition of the main burner gas is readily accomplished even at the minimum fire condition. In the industry this type of ignition system is referred to as an "intermittent pilot ignition system." These systems have generally required only one input for supervising or monitoring the presence of flame and that sensor is typically located in close proximity to the pilot flame so as to sense its presence. In some ignition systems, gas flow to the pilot burner would be shut off after adequate time had expired for establishing the main burner flame, thereby having the flame sense circuit actually sense the main burner flame once the pilot flame had extinguished itself. This type of ignition system is referred to as an "interrupted pilot ignition system."

Direct ignition systems are another means for lighting the main burner gas. In this system, the pilot system is omitted. Ignition of the main burner occurs immediately after the main gas valve is energized. There is a variation of this type of ignition system which may be referred to as a "proven source" type of direct ignition system where current flow to the ignition device is confirmed to be functioning properly prior to opening the main burner gas. All of the above ignition systems have functioned equally as reliably for many years in millions of different heating appliances.

It is generally recognized that a properly designed direct ignition system in a direct gas-fired industrial air heater or make-up air heater application is most difficult or challenging from an engineering standpoint since this type of system is required to ignite the main burner over an extremely wide range of gas flow rates.

To contemplate this aspect of the application challenge in a more detailed manner, one needs to understand that the ignition source, whether it is a high voltage spark or a hot surface ignition device, is generally only present for a few seconds and can be extremely small with respect to the size of burner that it is being utilized on. Gas flow must reach the area of the burner where the ignition source is located with the proper fuel to air ratio to obtain ignition.

During the development of the Harmonized Standard for Direct Gas-Fired Industrial Air Heaters between the United States and Canada, a provision was added that required the main burner flame supervision means for burners over 36 inches in length to be as remote as possible from the ignition source in order to ensure flame propagation has occurred and is maintained over the entire length of burner. To accommodate this requirement in pilot ignition type systems, a second flame detection device can been employed along with the associated controls which switches the pilot sensing system to the main burner flame sense controls after a preset time delay which allows for the flame to propagate across the burner length.

The impact of this provision was found to be more problematic for direct ignition systems with regard to ignition at the minimum fire condition and the time required for that small flame to propagate across the full length of the burner. The flame establishment time period typically only last for only a few seconds after the main gas shut-off valves are energized. The ANSI standard limits the flame establishing time period to a maximum of 15 seconds for direct ignition systems with burners rated over 400,000 Btu/hr and it is understandable why the manufacturer would desire to keep this time as short as possible. Direct fired heaters are not vented and in the case of a delayed or failed ignition, raw gas is dumped into the space being heated. Even though the actual quantity of gas may be small and not pose an unsafe condition for the building or its occupants, the odor from the gas may unnecessarily incite panic to the inhabitants of the building.

Without one of the control methodology provided as the basis for this patent, the minimum gas flow adjustment would have to be significantly increased or other more expensive gas flow controls systems employed for direct ignition type systems to ensure that the flame would propagate across the burner within the flame establishment time period. Longer burners would require a higher minimum fire adjustment to account for the distance that the flame has to travel. The downside of increasing the minimum gas flow rate is that the minimum temperature is increased which then results in overheating of the conditioned space during mild weather conditions.

An alternate control approach mentioned above for gas flow control would involve providing a separate gas piping system which would be energized for each for each ignition attempt and provide the flow of gas necessary to achieve the flame travel speed to complete the flame sense circuit before the flame establishing time period expires. It was noted that this solution was significantly more expensive than the other control methodologies presented within the scope of this patent coverage. This is because the separate gas piping system would require a gas valve with redundant valve seating and a regulator and/or flow regulating cock to simulate a variable orifice, either or both provided as a means to adjust the gas flow precisely to obtain the desired effect. In addition, a time delay relay would be necessary to energize the primary gas controls for the heater after the flame had been properly established and de-energize the low fire start controls. In this type of arrangement, a low fire start setting can be employed without sacrificing the lowest possible minimum fire setting, thus the minimum temperature rise aspect of the make-up air heater is maintained.

The current invention has been designed to provide a less expensive solution for direct ignition control system while maintaining the minimum firing rate at the lowest possible and achieving consistent ignition performance at a pre selected "low fire start" setpoint.

SUMMARY OF THE INVENTION

The subject matter of this invention contemplates different control circuit methodologies which provide a means for achieving a low fire start condition which is elevated above the minimum firing rate for the purpose of igniting gas for a direct fired burner using a direct ignition system as the ignition source and detecting the presence of flame at a point that is as remote as possible from the ignition source within the flame establishing time period. It is understood by the essence of this coverage that merely leaving the power off to the modulating valve and adjusting the minimum firing rate high enough to achieve ignition and flame detection within the flame establishing time period is unacceptable because it has the secondary negative effect of raising the minimum temperature rise through the heater which is likely to overheat the space being heated during mild or moderate ambient weather conditions.

There are six basic variations of control operations for setting up the low fire condition necessary to achieve the desired ignition performance on direct ignition systems for which patent coverage is being sought. They are as follows:

1. Provide a simulated resistance circuit which bypasses the discharge temperature sensors, remote temperature selector, and/or space temperature controls which has the effect of driving the modulating valve to a fixed open setting which can be adjusted by changing the resistance setting of the simulated resistance which in turn changes the valve voltage to open or close the modulation valve to obtain the desired gas flow rate. See FIGS. 4 through 6.
2. Provide an isolated dc voltage source which bypasses the normal system voltage input to the modulating valve and has the effect of driving the modulating valve to a fixed open setting which can be adjusted by changing the voltage input to the modulating valve to open or close the modulating valve to obtain the desired gas flow rate. See FIGS. 7 through 9.
3. Provide a microprocessor base control system which is capable of driving a stepper motor to a pre-selected number of steps open or closed from a known open or closed position which has the effect of driving the modulating valve to a fixed open setting which can be adjusted in a number of different methods including, but not limited to, selecting the number of step from a given position for the stepper motor to move to open or close the modulating valve to obtain the desired gas flow rate.
4. Provide an intermediate limit switch position which relates to the openness of the modulating valve and which causes the modulating valve to stop at a pre-selected degree of openness in order to obtain the desired gas flow rate. The intermediate limit switch can be mounted on a slide mechanism or adjustable cam means which provides for pre-selected adjustments for adjusting the flow rate through the valve.
5. Provide a modified version of the input parameter provided in design number 3 above which can monitor the output of a variable frequency drive system which has the capability of varying the air flow through the heater and which requires adjustments of the gas flow rate as a function of the specific airflow or speed of the variable frequency drive in as much the relative speed of the heater is tracked and a variable low fire start setting can be adjusted to match the specific air flow present by changing the degree of openness of the modulating valve by counting the number of steps of the valve from a known open or closed valve position.
6. Provide a bypass gas flow arrangement which can be adjusted to supply the proper flow of gas during the ignition cycle to obtain the desired results. This was discussed in the background of the invention section discussed earlier. See FIG. 13.

It is recognized that each of the bypass arrangements are controlled by a timing circuit which revert back to normal operation after a delay of ten to thirty seconds.

It is also recognized that an energy management system or master heater control system which controls the modulation of the gas during heater operation by directly providing an input signal to the modulating valve could be programmed to control the voltage during burner ignition directly so as not to need to use a bypass system but still benefit from the essence of this patent.

An inherent benefit of this patent is that by igniting the burner at essentially a one fixed firing rate, the reliability of the burner ignition is enhanced over the systems where ignition occurs over a broader firing rate.

DESCRIPTION OF THE PREFERRED EMBODIMENTS

Figure 1:
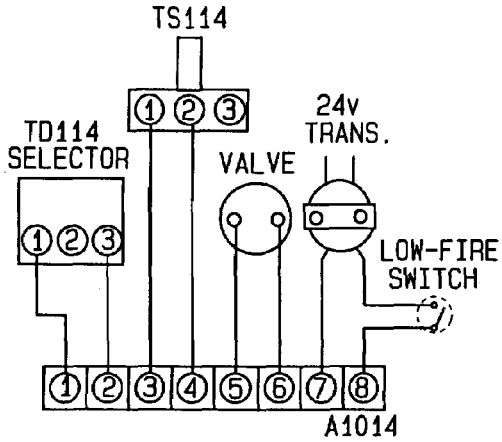
FIG. 1 PRIOR ART
FIG. 1 is an electrical diagram of a prior art modulating control system.

FIG. 1 is a sketch of an electrical diagram of a standard off-the-shelf Maxitrol Series 14 modulating control system which is offered to the gas industry today. This control system provides a fixed discharge temperature as defined by the TD114 TEMPERATURE SELECTOR control setting. It includes a switch contact which is identified as a LOW-FIRE SWITCH that is located in the 24 volt supply leg of the circuit. When this contact is in the opened position, the power to the control is removed and the modulating valve, identified as VALVE in the sketch, receives no power. This is the method that Maxitrol utilizes to create what they term as the Low Fire Start option when its actions actually causes the system to assume the preset minimum fire state. The other components of the Series 14 control system include: the TS114 duct sensor which provides feedback of the temperature being discharged; and the A1014 device which is a black box type of control that Maxitrol refers to as an amplifier. The A1014 functions to provide the modulating valve with a 0 to 24 volt dc signal in response to a resistance imbalance between the duct sensor and the discharge temperature selector.

Figure 2:
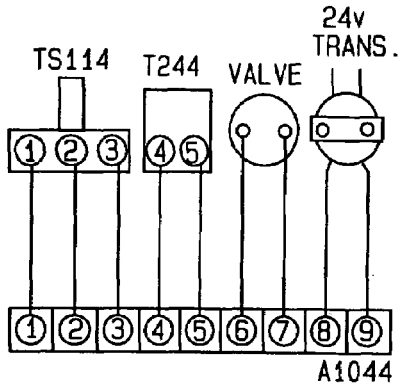
FIG. 2 PRIOR ART
FIG. 2 is an electrical diagram of a prior art modulating control system.

FIG. 2 is a sketch of an electrical diagram of a standard off-the-shelf Maxitrol Series 44 modulating control system which is offered to the gas industry today. This control system provides controls to maintain the space temperature at the temperature set on the T244 ROOM TEMPERATURE control and allows the discharge temperature to vary between the maximum and minimum set points which is found on the A1044 black box type control that Maxitrol refers to as an amplifier. No low fire start option is shown in this sketch, however, if provided, it would be accomplished in a similar manner to that shown in FIG. 1 and would yield the same minimum fire start state. The duct sensor, TS144 provides a feedback resistance signal to the A1044 amplifier which causes the amplifier to vary the voltage signal to the VALVE between 0 and 24 volts dc to maintain the desired room temperature.

Figure 3:
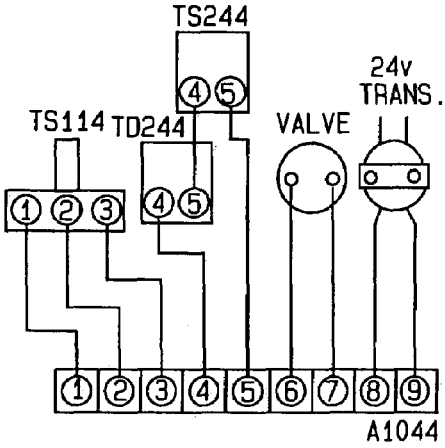
FIG. 3 PRIOR ART
FIG. 3 is an electrical diagram of a prior art modulating control system.

FIG. 3 is a sketch of an electrical diagram of a standard off-the-shelf Maxitrol Series 44 modulating control system with a REMOTE SENSE option which is offered to the gas industry today. This control systems functions like that shown in FIG. 2 except the space temperature setting is set on the TD244 SPACE TEMPERATURE SELECTOR and the space temperature is sense by the TS244 SPACE SENSOR. This variation of the control system is provided so the SPACE TEMPERATURE SELECTOR control can be secured so unauthorized personnel can't make adjustments to the room temperature setting.

Figure 4:
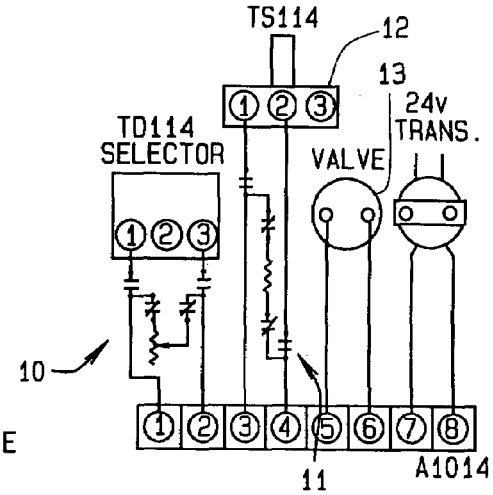
FIG. 4 discloses circuitry for isolating relay contacts for bypassing the discharge temperature selector resistance and the discharge temperature sensor resistance during burner ignition.

FIG. 4 is a modification of FIG. 1 where isolating relay contacts 10 bypass the DISCHARGE TEMPERATURE SELECTOR and inserts a variable resistance between terminals 1 and 2 of the A1014 amplifier and a separate set of isolating contacts 11 bypasses the DUCT SENSOR 12 and inserts a fixed resistor between terminals 3 and 4 of the A1014 amplifier. By adjusting the variable resistor connected between terminals 1 and 2, the voltage signal to the modulating valve 13 can be precisely set to the voltage necessary to achieve the gas flow desired to satisfy the requirements of the low fire start function as it is defined in this document.

Figure 5:
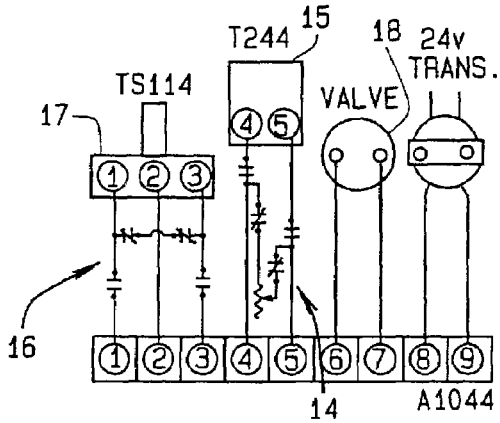
FIG. 5 discloses isolating relay contacts for bypassing the discharge temperature through the use of short circuitry, and for bypassing the space temperature sensor resistance.

FIG. 5 is a modification of FIG. 2 where isolating relay contacts 14 bypass the DISCHARGE TEMPERATURE SENSOR 15 and inserts a short circuit between terminals 1 and 3 of the A1044 amplifier and a separate set of isolating contacts 16 bypasses the ROOM TEMPERATURE SELECTOR 17 and inserts a variable resistor between terminals 4 and 5 of the A1044 amplifier. By adjusting the variable resistor connected between terminals 4 and 5, the voltage signal to the modulating valve 18 can be precisely set to the voltage necessary to achieve the gas flow desired to satisfy the requirements of the low fire start function as it is defined in this document.

Figure 6:
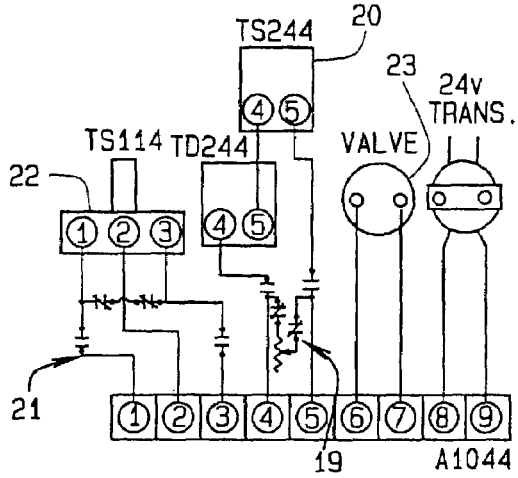
FIG. 6 discloses an isolating relay contact for bypassing the discharge temperature sensor through the use of short circuitry, and for bypassing the resistance combination of the space sensor and space temperature selector.

FIG. 6 is a modification of FIG. 3 where isolating relay contacts 19 bypass the DISCHARGE TEMPERATURE SENSOR 20 and inserts a short circuit between terminals 1 and 3 of the A1044 amplifier and a separate set of isolating contacts 21 bypasses the ROOM TEMPERATURE SELECTOR 22 and inserts a variable resistor between terminals 4 and 5 of the A1044 amplifier. By adjusting the variable resistor connected between terminals 4 and 5, the voltage signal to the modulating valve 23 can be precisely set to the voltage necessary to achieve the gas flow desired to satisfy the requirements of the low fire start function as it is defined in this document.

Figure 7:
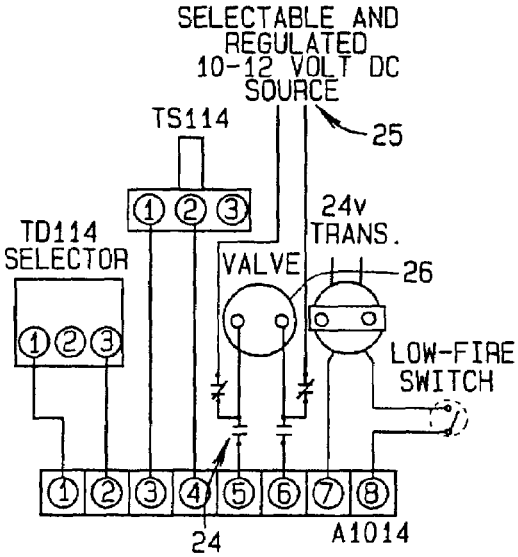
FIG. 7 discloses isolating relay contacts for bypassing an output signal and inserting an input signal from a separate voltage source.

FIG. 7 is a modification of FIG. 1 where isolating relay contacts 24 bypass the output signal of the A1014 amplifier and inserts the input signal from a separate 0 to 24 volt voltage source 25. By adjusting the voltage signal to the modulating valve 26, the gas flow can be precisely set to achieve the gas flow desired to satisfy the requirements of the low fire start function as it is defined in this document.

Figure 8:
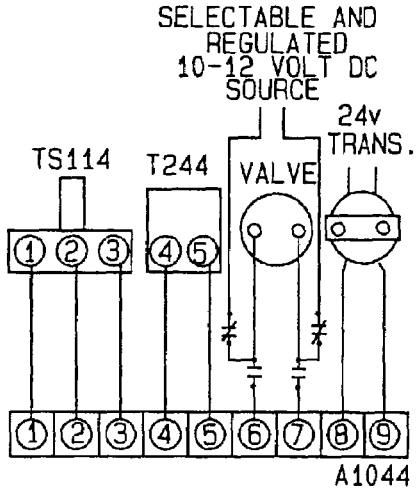
FIG. 8 discloses isolating relay contacts for bypassing the output signal and inserting an input signal from a separate voltage source.

FIG. 8 is a modification of FIG. 2 where isolating relay contacts 27 bypass the output signal of the A1044 amplifier and inserts the input signal from a separate 0 to 24 volt voltage source. By adjusting the voltage signal to the modulating valve 28, the gas flow can be precisely set to achieve the gas flow desired to satisfy the requirements of the low fire start function as it is defined in this document.

Figure 9:
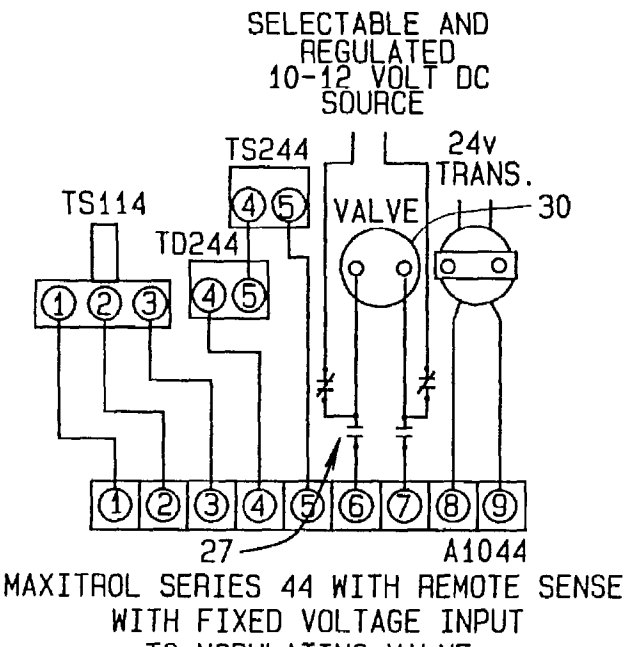
FIG. 9 shows isolating relay contacts for bypassing an output signal and inserting an input signal from a separate voltage source.

FIG. 9 is a modification of FIG. 3 where isolating relay contacts 29 bypass the output signal of the A1044 amplifier and inserts the input signal from a separate 0 to 24 volt voltage source. By adjusting the voltage signal to the modulating valve 30, the gas flow can be precisely set to achieve the gas flow desired to satisfy the requirements of the low fire start function as it is defined in this document.

Figure 10:
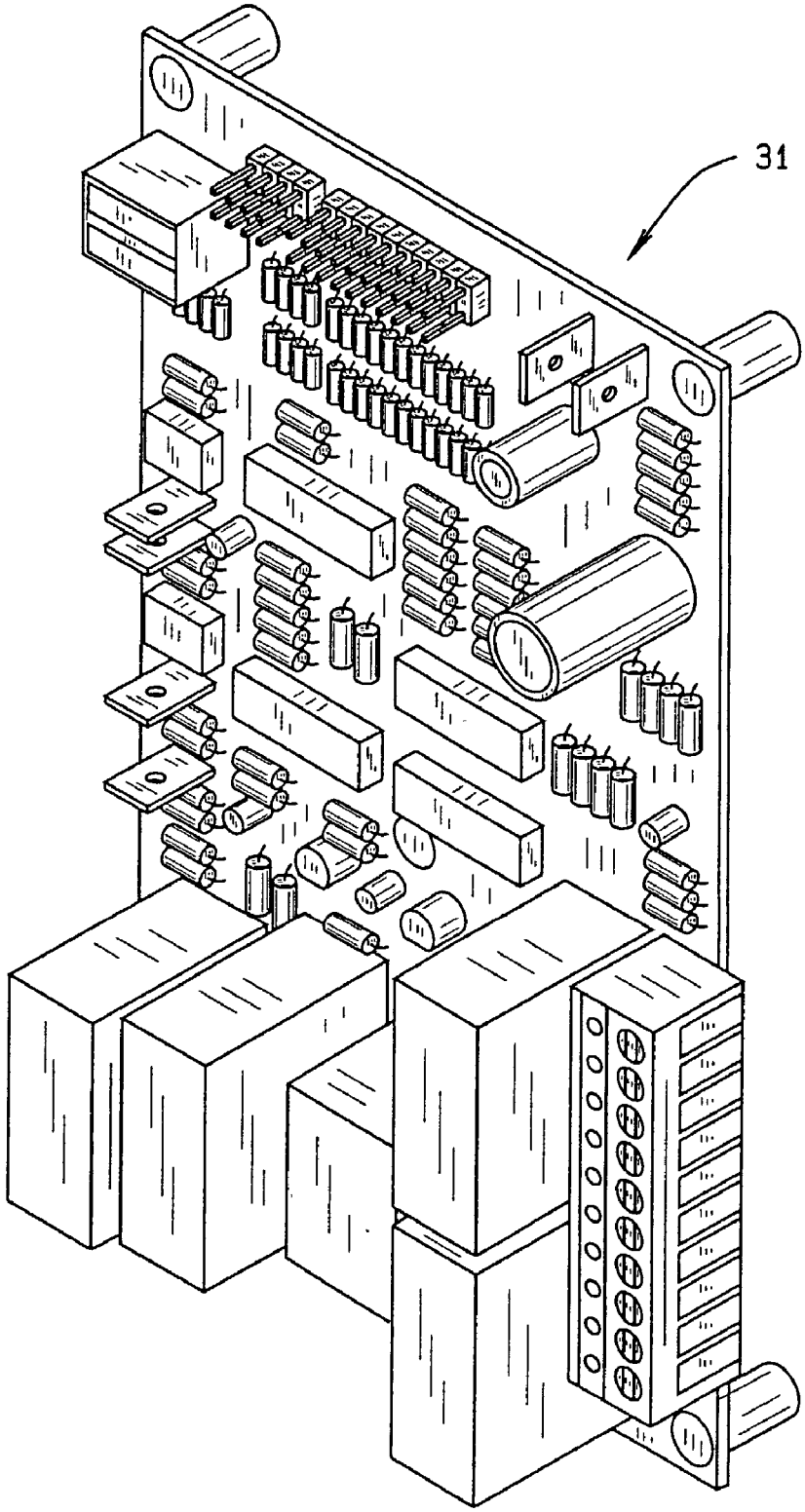
FIG. 10 is a printed circuit board for use in controlling the circuitry of this invention.

FIG. 10 shows a printed circuit board 31 which includes the circuitry needed to accomplish the functions shown in FIGS. 4, 5, and 6.

Figure 11:
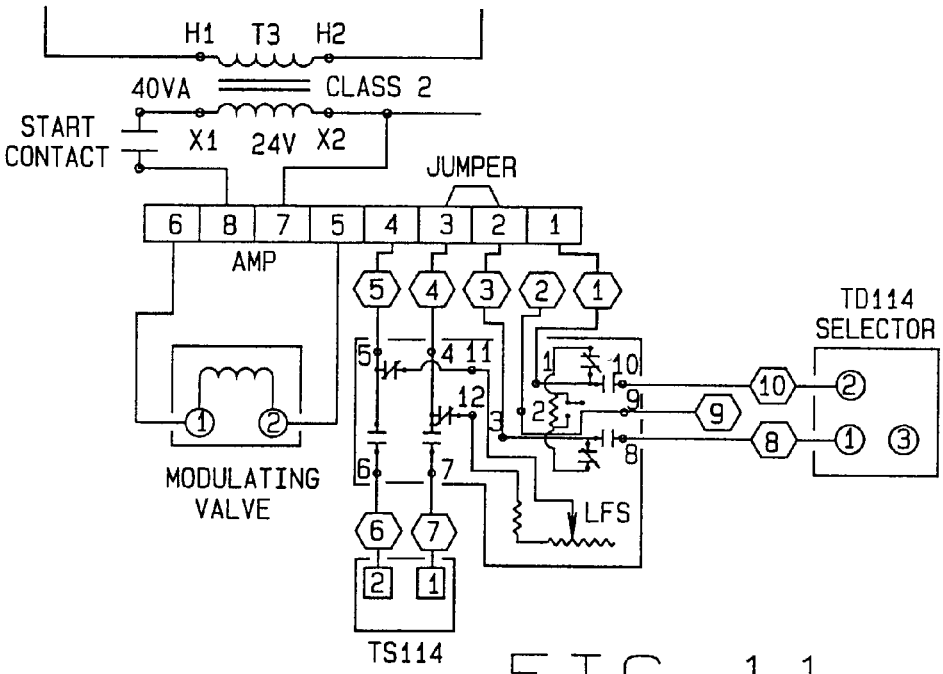
FIG. 11 discloses an electrical circuitry for combining the printed circuit board of FIG. 10 with the various electrical diagrams for circuitry shown in FIG. 4.

FIG. 11 is a sketch of the electrical connections made between the pc board of FIG. 10 and the electrical diagram of FIG. 4 for the Series 14 control system.

Figure 12:
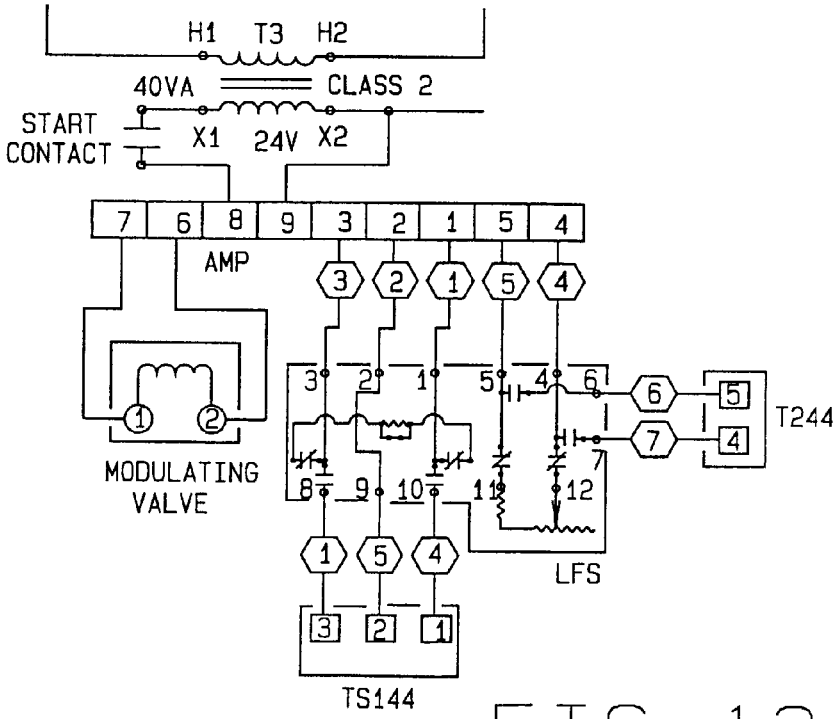
FIG. 12 discloses electrical circuitry for interconnection between the printed circuitry board of FIG. 10 and the electrical circuitry of FIGS. 5 and 6.

FIG. 12 is a sketch of the electrical connections made between the pc board of FIG. 10 and the electrical diagrams of FIG's 5 and 6. Note that a jumper plug has been used to accomplish the shorting of the fixed resistor between terminals 1 and 3 which was used for the Maxitrol Series 14 control system.

Figure 13:
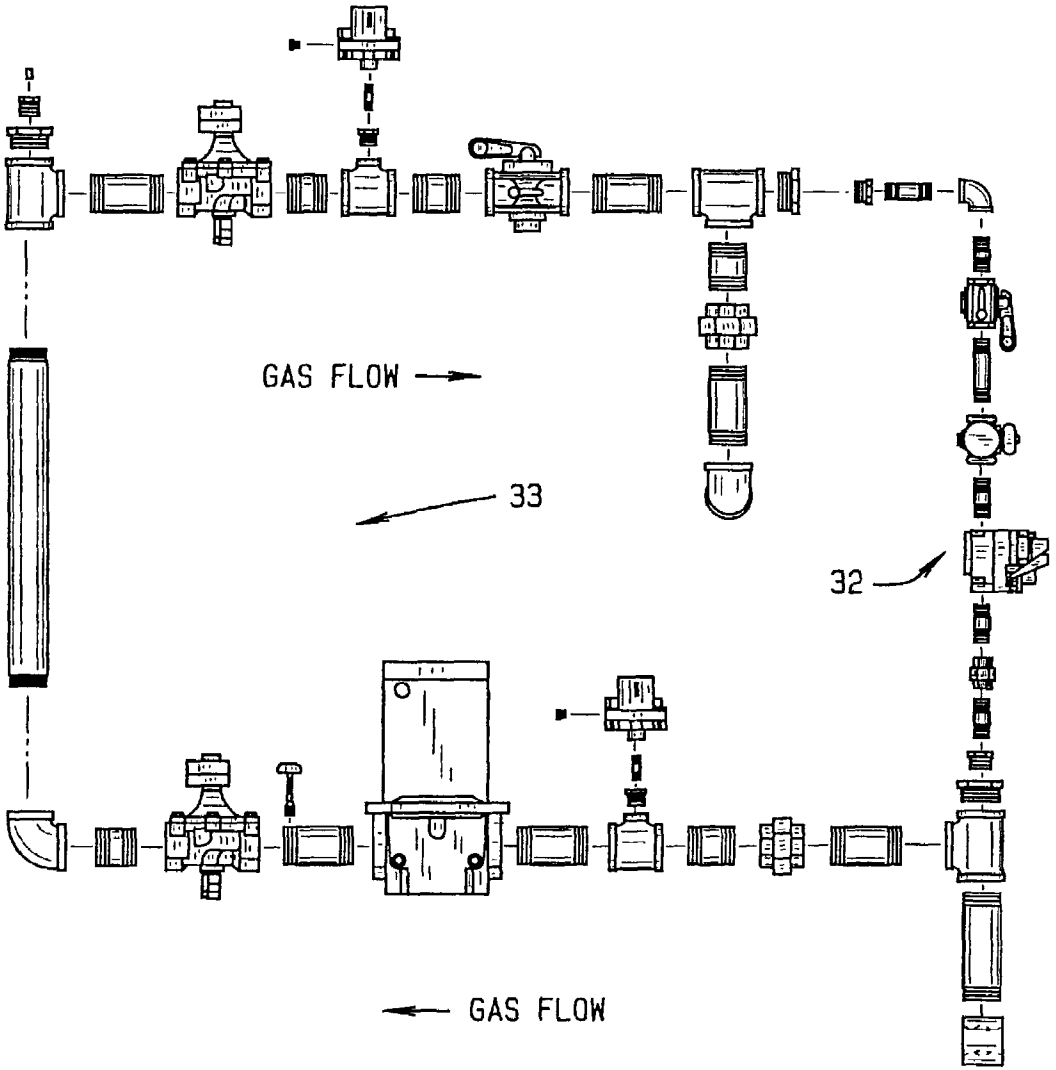
FIG. 13 discloses the bypass gas flow arrangement for adjusting the supply and proper flow of gas during ignition of the burner assembly.

FIG. 13 is a drawing of a gas train where a bypass flow circuit 32 has been set up to provide the low fire start function through the vertical path from the supply connection to the burner manifold. Item 26' on this drawing is the gas shut-off valve and item 27' is the throttling cock for fine tuning the gas flow for the low fire start function. The main gas train 33 remains unchanged with the minimum fire still controlled by the modulating/regulating valve, item 19' in the drawing.

Variations or modifications to the subject matter of this disclosure may occur to those skilled in the art upon reviewing the summary as provided herein, in addition to the description of its preferred embodiments. Such variations or modifications, if within the spirit of this development, are intended to be encompassed within the scope of the invention as described herein. The description of the preferred embodiment as provided, and as show in the drawings, is set forth for illustrative purposes only.

The invention claimed is:

1. A control system for a direct fire gas burner comprising:

a modulating valve for controlling gas output to the burner;

a control in electrical communication with the burner and with said modulating valve;

said control providing a low fire start gas condition of the burner above a minimum firing rate as said control interrupts electrical power to said modulating valve therein adjusting the flow of gas attaining a low fire start;

one of a space temperature selector in electrical communication with said valve and said control and a discharge temperature sensor in electrical communication with said valve and said control; and, a simulated resistance circuit within said control capable of driving the modulating valve to an open setting in response to a resistance setting; the simulated resistance circuit comprising:

a first bypass circuit which bypasses said space temperature selector, said first bypass circuit including contacts to selectively open and close said first bypass circuit; and, a second bypass circuit which bypasses said discharge temperature sensor; said second bypass circuit including contacts to selectively open and close said second bypass circuit.

2. The control system of claim 1 and further comprising:

said simulated resistance circuit bypassing the discharge temperature sensor and the space temperature selector, and driving the modulating valve to an open setting in response to a resistance setting.

3. The control system of claim 1 wherein at least one of said first bypass circuit and said second bypass circuit includes a resistor.

4. The control system of claim 3 wherein both said first bypass circuit and said second bypass circuit include a resistor.

5. The control system of claim 3 wherein said resistor is a variable resistor.

* * * * *